United States Patent [19]

Kero

[11] Patent Number: 4,862,666

[45] Date of Patent: Sep. 5, 1989

[54] PROFILED SHEET FOR BUILDING PURPOSES

[75] Inventor: Ernst Kero, Luleå, Sweden

[73] Assignee: Plannja AB, Luleå, Sweden

[21] Appl. No.: 155,530

[22] Filed: Feb. 12, 1988

[30] Foreign Application Priority Data

Feb. 16, 1987 [SE] Sweden ..... 8700623

[51] Int. Cl.[4] ..... E04C 2/30; E04C 2/32

[52] U.S. Cl. ..... 52/630; 52/795; 52/814; 428/161; 428/182; 428/600; 72/180

[58] Field of Search ..... 52/630, 450, 674, 796, 52/795, 814, 336; 428/599-604, 161, 182-186, 600; 72/180, 181

[56] References Cited

U.S. PATENT DOCUMENTS

| | | | |
|---|---|---|---|
| 1,517,633 | 12/1924 | Junkers | 428/603 |
| 1,761,137 | 6/1930 | Louden | 428/599 |
| 2,118,499 | 5/1938 | Durbin | 29/34 R |
| 2,294,890 | 9/1942 | Brinker | 52/796 |
| 3,165,815 | 1/1965 | Wogerbauer | 72/180 |
| 3,224,205 | 12/1965 | Greiner et al. | 52/630 |
| 3,273,976 | 9/1966 | Wogerbauer | 428/603 |
| 3,820,295 | 6/1974 | Folley | 52/630 |

*Primary Examiner*—James L. Ridgill, Jr.

*Attorney, Agent, or Firm*—Fleit, Jacobson, Cohn, Price, Holman & Stern

[57] ABSTRACT

The invention relates to a profiled sheet for building purposes, especially roofing and facade sheet, the sheet having a normal profiling and having in addition, at least in certain sections, a corrugated microprofiling deviating from the normal profiling. The microprofiling exhibits flattened and/or pressed-in areas in its crest, valley and/or flank sections resulting in that the thickness of the profiled sheet varies in a direction transversely of the longitudinal direction of the microprofiling which agrees with the longitudinal direction of the normal profiling. The flattened and/or pressed-in areas extend in the longitudinal direction of the microprofiling.

4 Claims, 4 Drawing Sheets

PROFILED SHEET FOR BUILDING PURPOSES

This invention relates to a profiled sheet for building purposes, especially roofing and facade sheet, said sheet comprising a normal profiling and in addition, at least in certain sections, a corrugated microprofiling deviating from the normal profiling.

Profiled sheet for building purposes, especially so-called roofing sheet and facade sheet, are normally made with some type of profiling for the purpose of giving the mostly relatively thin sheet enough stiffness against undesired deformation and in order to prevent penetration of water into the joint areas and to control outflow of water. Moreover, the sheets are sometimes provided with very deep profiling so that they will qualify for instance to replace certain beams carrying a roof construction. There is a lot of different alternative profiling designs for e.g. roofing sheet in the market.

When manufacturing the above-mentioned profiled sheet the starting material in the form of e.g. a plane band of thin sheet arranged in a roller must be suitable for satisfying certain required criteria as to e.g. material quality and yield strength. Due to said criteria one has so far been reduced to using a relatively expensive starting material for manufacture of the profiled sheet.

In order to improve the strength of the profiled sheet it has so far been suggested that microprofiling further stiffening the sheet and comprising a number of corrugations of a varying appearance is arranged in addition to the normal profiling. Of course this is a correct measure but at the same time this microprofiling has an injurious effect on the final width measure of the profiled sheet as it will consume material due to its corrugation resulting in that a wider starting material is required.

It is the object of this invention to provide a perfectly satisfactory profiled sheet, for the manufacture of which a less expensive starting material in the form of a plane sheet can be used and this object is achieved in that the profiled sheet has been given the characteristic features defined in the claims.

Thanks to the invention a considerably greater freedom of choice is offered as far as starting material for the profiled sheet is concerned. Thus, e.g. a thin sheet of "unsorted"/varying quality can be used and, if desired, the sheet thickness of the profiled products may also be reduced to some extent. Another advantage of the invention is that big plane surfaces of the profiled sheet remain plane even when a very thin starting material is used due to a contracting effect exerted by the inventive microprofiling. In addition it can be mentioned that the microprofiling of the sheet can be carried out as desired before, in connecting with and/or after normal profiling of the sheet. Thus, one has a greater freedom of choice as to working order in the manufacture of the inventive profiled sheet. A microprofiling station comprising rolls made for this can be integrated in a process line for profiled sheet without influencing the manufacturing capacity of the line in a negative direction.

A very great advantage of the invention is that the reduction of width of the sheet material arising due to the corrugation of the microprofiling is counteracted and can even be eliminated thanks to the inventive flattened and/or pressed-in areas in crest, valley and/or flank sections of the microprofiling. Due to the redistribution of material then taking place a further increase of the material strength is achieved meaning that the reduction of the sheet thickness arising as a consequence of the flattened and/or pressed-in areas need not have any negative influence on the physical properties of the profiled sheet.

Illustrative examples of the invention will be described in greater detail in the following with reference to the enclosed drawings, wherein FIG. 1 is a perspective view of a section of a sheet provided with a profiling, FIGS. 2–3 are perspective views of sections of profiled sheets formed with corrugated microprofiling, FIG. 4 shows a section of an example of the design of the microprofiling on a larger scale, and FIGS. 5–12 show sections of a number of examples of the design of the inventive microprofiling on a still larger scale.

Figure 3:
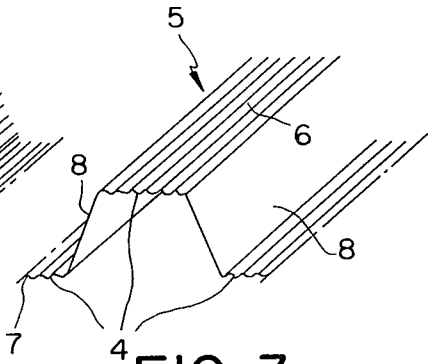

FIG. 3 shows an example of a profiled sheet 5 where limited sections of the normal profiling are provided with microprofiling 4. In this case the crests 6 and bottoms 7 of the normal profiling are microprofiled while the lateral flanks 8 of the normal profiling are lacking microprofiling. Thus, it will be appreciated that the microprofiling of course can be limited to the surfaces where best needed. Thus, many variations are possible; it may sometimes be sufficient, for example, to provide the top surfaces 6 of the normal profiling only with microprofiling.

Figure 4:
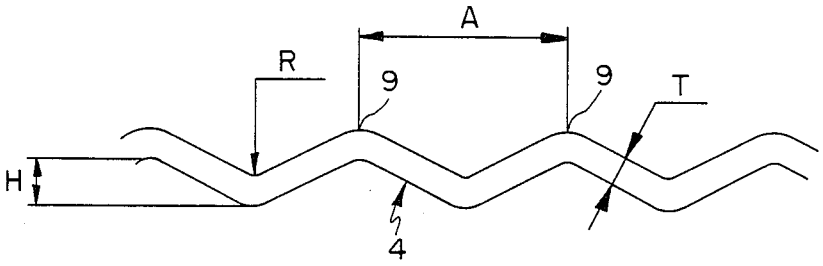

FIG. 4 shows on a larger scale an example of a microprofiling 4. However, it will be appreciated that the microprofiling can be embodied in another way than shown here, e.g. sinusoidal. However, it is essential that it consists of a wave pattern of some form lying closely together. In order to clarify more in detail what it is intended by microprofiling in this connection it should be stated that the distance A between two adjacent corresponding parts thereof, e.g. wave crests 9, should preferably be less than 15 times the sheet thickness T and conveniently be of the order of 3–6 times the sheet thickness T. As a non-limiting example $T=0.6$ mm, $A=3.5$ mm, $H=0.8$ mm and $R=0.5$ mm can be mentioned.

What characterizes the inventive profiled sheet is that its thickness varies in a direction transversely of the longitudinal direction of the microprofiling and a number of examples is shown in FIGS. 5–12 how this can be achieved, for example in the form of flattened and/or pressed-in areas in the crest, valley and/or flank sections of the microprofiling. Said flattened and pressed-in areas are preferably achieved in that the tools forming the waviness of the microprofiling are also so made that they form the flattened and pressed-in areas at the same time.

Figure 5:
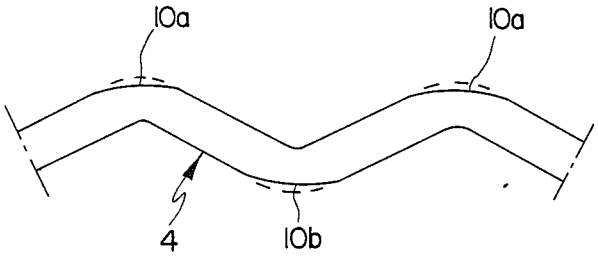

In FIG. 5 a microprofiling is shown were variation of plate thickness has been obtained by the arrangement of flattened areas 10*a*, 10*b* on the wave crests/crest sections of the microprofiling, said areas extending along the whole length of the microprofiling according to the invention. It is marked in the figure with dashed lines how the appearance of the microprofiling should be if it was lacking the inventive flattened areas reducing the sheet thickness. Said marking with dashed lines has also been used in the other figures to show differences in relation to constant sheet thickness.

Figure 6:
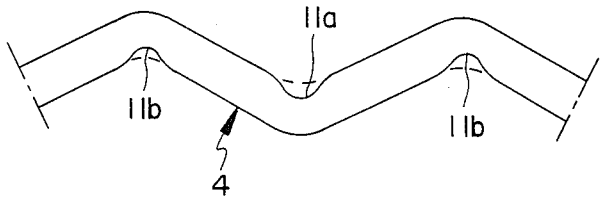

FIG. 6 shows an inventive embodiment were pressed-in areas 11*a*, 11*b* reducing sheet thickness have been arranged in the valley sections of the microprofiling.

Figure 7:
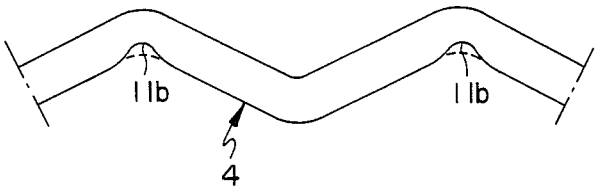

FIG. 7 shows an embodiment where merely pressed-in areas 11*b* have been arranged on the underside of the microprofiling which brings a minimum influence on the appearance of the microprofiling that sometimes may be desirable for aesthetical reasons.

Figure 8:
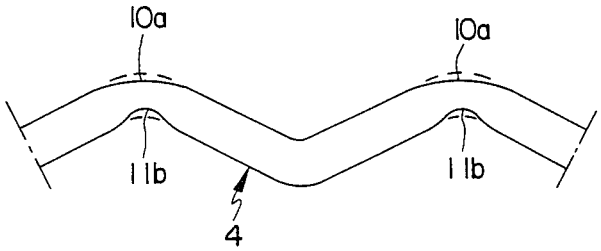

FIG. 8 shows an embodiment where both flattened 10*a* and pressed-in 11*b* areas are arranged in connection with the microprofiling.

Figure 9:
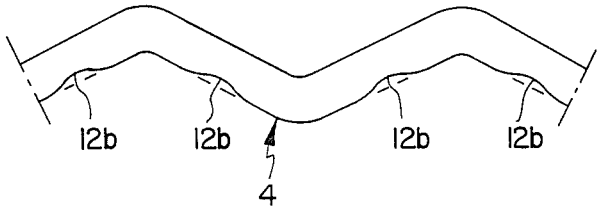

As shown in FIG. 9 pressed-in areas 12*b* can also be arranged extending along the flank surfaces of the microprofiling 4.

Figure 10:
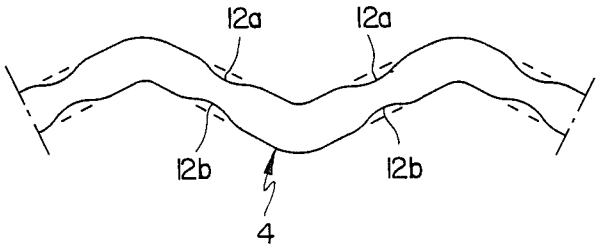

FIG. 10 shows the possibility of arranging pressed-in areas 12*a*, 12*b* both on the upper sides and undersides of the flank surfaces.

Figure 11:
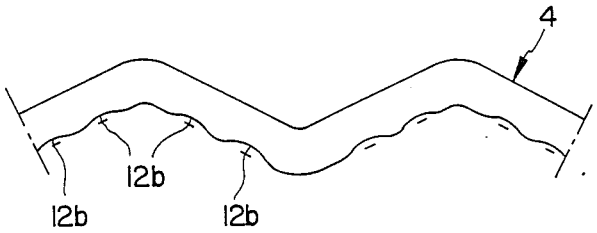

FIG. 11 exemplifies the possibility of arranging several adjacent pressed-in areas 12*b*.

Figure 12:
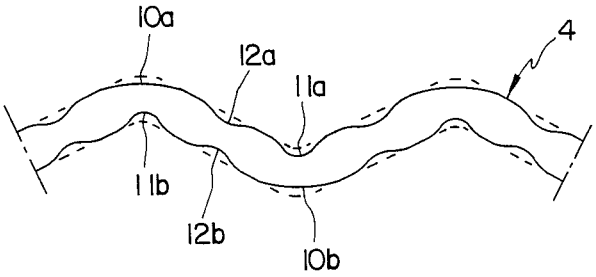

In FIG. 12 the possiblity is exemplified to use at the same time the flattened crest areas 10*a*, 10*b*, the pressed-in valleys 11*a*, 11*b* and the pressed-in flank areas 12*a*, 12*b*.

The combination possiblities are unlimited and the flattened and/or pressed-in areas need of course not be arranged on all microprofiling waves.

Thus, it will be appreciated that the form and number of the flattened and pressed-in areas of course can vary within the scope of the invention.

Generally the flattened and/or pressed-in areas of course extend along the whole length of the profiling. It can be mentioned as a non-limiting example that the thickness of the profiled sheet, as a consequence of the flattened and/or pressed-in areas, for example can be varied between 70% and 100% of the original sheet thickness.

Figure 1:
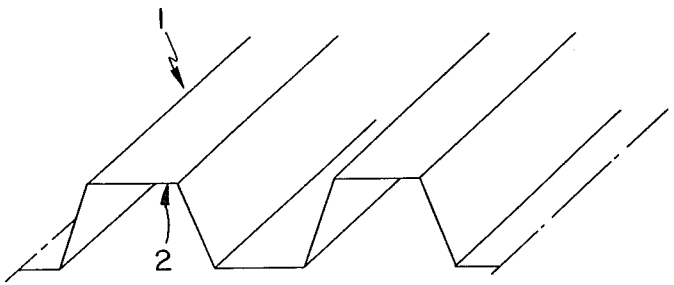
FIG. 1 shows an example of a profiled sheet 1 and one of many possible embodiments of what is called normal profiling 2 in this connection. As far as profiled sheet for building purposes is concerned there is a plurality of embodiments of this so-called normal profiling and of course the invention is useful in connection with all possible embodiments of this so-called normal profiling.
Figure 2:
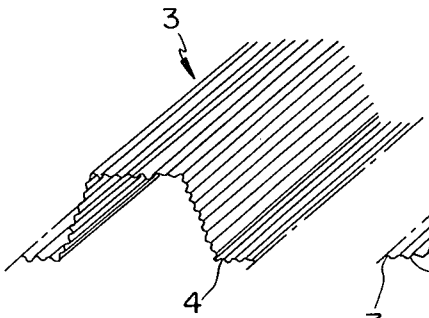
FIG. 2 shows a profiled sheet 3 being provided with microprofiling throughout its normally profiled surface in the form of small waves 4 which, thus, extend along all surfaces thereof independently of the configuration of the normal profiling.

As to the embodiment shown in FIG. 2 it is suitable to perform the microprofiling with associated flattened and/or pressed-in areas before the normal profiling is carried out while, if desired, in the embodiment shown in FIG. 3 the microprofiling with associated flattened and/or pressed-in areas also can be carried out simply after the normal profiling has been made.

The invention is not limited to what has been shown and described, but amendments and modifications thereof are possible within the scope of the appended claims.

What is claimed is:

1. Profiled sheet for building purposes, especially roofing and facade sheet, said sheet comprising a main profiling having repetitive crest, valley and shank sections, and at least in certain sections of the sheet corrugated microprofiles superimposed on the main profiling such that the thickness of the profiled sheet varies in a direction transversely of a longitudinal direction of the microprofiles, each microprofile having respective crest, valley and shank sections characterized in that the thickness of the profiled sheet is partially reduced by a pressed-in area in at least one of the crest, valley and flank sections of each microprofile.

2. The profiled sheet of claim 1, characterized in that the pressed-in areas extend in the longitudinal direction of the microprofiles.

3. The profiled sheet of claim 1, characterized in that the pressed-in areas are located on one side of the profiled sheet.

4. The profiled sheet of claim 1, characterized in that the pressed-in areas are located on both sides of the profiled sheet.

* * * * *